US009109183B2

(12) United States Patent
Carli

(10) Patent No.: US 9,109,183 B2
(45) Date of Patent: Aug. 18, 2015

(54) LUBRICATING COMPOSITIONS FOR CONTINUOUS CASTING PROCESSES AND METHODS FOR MAKING AND USING SAME

(71) Applicant: PROSIMET S.p.A., Filago, Bergamo (IT)

(72) Inventor: Riccardo Carli, Bergamo (IT)

(73) Assignee: PROSIMET S.p.A., Filago, Bergamo (IT)

( * ) Notice: Subject to any disclaimer, the term of this patent is extended or adjusted under 35 U.S.C. 154(b) by 137 days.

(21) Appl. No.: 13/764,795

(22) Filed: Feb. 12, 2013

(65) Prior Publication Data

US 2013/0206353 A1 Aug. 15, 2013

(30) Foreign Application Priority Data

Feb. 13, 2012 (EP) ..... 12425029

(51) Int. Cl.

| | |
|---|---|
| ***C10M 169/00*** | (2006.01) |
| ***C10M 125/26*** | (2006.01) |
| ***B22D 11/07*** | (2006.01) |
| ***C10M 141/04*** | (2006.01) |
| *C10M 125/10* | (2006.01) |
| *C10M 125/04* | (2006.01) |
| *C10M 125/00* | (2006.01) |
| *C10M 169/04* | (2006.01) |

(52) U.S. Cl.

CPC ..... *C10M 125/26* (2013.01); *B22D 11/07* (2013.01); *C10M 141/04* (2013.01); *C10M 125/00* (2013.01); *C10M 125/04* (2013.01); *C10M 125/10* (2013.01); *C10M 169/00* (2013.01); *C10M 169/04* (2013.01); *C10M 2201/041* (2013.01); *C10M 2201/0413* (2013.01); *C10M 2201/062* (2013.01); *C10M 2201/0623* (2013.01); *C10M 2201/081* (2013.01); *C10M 2201/087* (2013.01); *C10M 2201/10* (2013.01); *C10M 2201/102* (2013.01); *C10M 2201/103* (2013.01); *C10M 2201/105* (2013.01); *C10M 2201/1006* (2013.01); *C10M 2201/1023* (2013.01); *C10M 2201/1033* (2013.01); *C10M 2201/1053* (2013.01); *C10M 2201/12* (2013.01); *C10M 2201/123* (2013.01); *C10M 2205/003* (2013.01); *C10M 2205/0285* (2013.01); *C10M 2207/281* (2013.01); *C10M 2207/2815* (2013.01); *C10M 2207/401* (2013.01); *C10N 2220/022* (2013.01); *C10N 2220/032* (2013.01); *C10N 2220/082* (2013.01); *C10N 2240/402* (2013.01); *C10N 2240/404* (2013.01); *C10N 2240/408* (2013.01); *C10N 2240/58* (2013.01); *C10N 2250/12* (2013.01); *C10N 2270/00* (2013.01)

(58) Field of Classification Search

CPC ..... C10N 2220/02; C10N 2230/02
USPC ..... 508/110
See application file for complete search history.

(56) References Cited

U.S. PATENT DOCUMENTS

| | | | | |
|---|---|---|---|---|
| 3,034,186 | A | 5/1962 | Holshouser | |
| 3,184,815 | A | 5/1965 | Reuter | |
| 3,411,564 | A | 11/1968 | Miller, Jr. | |
| 3,598,170 | A * | 8/1971 | Roberts | 164/72 |
| 3,964,916 | A * | 6/1976 | Armistead et al. | 75/305 |
| 4,009,748 | A | 3/1977 | Keddeinis et al. | |
| 5,934,359 | A * | 8/1999 | Strezov | 164/480 |
| 2011/0218128 | A1 * | 9/2011 | Hishinuma et al. | 508/181 |

FOREIGN PATENT DOCUMENTS

| | | |
|---|---|---|
| JP | 5111739 A | 5/1993 |

* cited by examiner

*Primary Examiner* — Taiwo Oladapo
(74) *Attorney, Agent, or Firm* — Robert E. Alderson, Jr.

(57) ABSTRACT

Lubricating compositions for use in the casting of steel, in particular in continuous casting processes are provided. Methods for making and using such compositions are also provided.

16 Claims, No Drawings

LUBRICATING COMPOSITIONS FOR CONTINUOUS CASTING PROCESSES AND METHODS FOR MAKING AND USING SAME

CROSS REFERENCE TO RELATED APPLICATION

This application claims priority to and benefit of European Patent Application No. 12425029.1 filed Feb. 13, 2012, the contents of which are incorporated by reference in their entirety.

FIELD OF THE INVENTION

The present invention relates to a lubricating composition to be used for the casting of steel, in particular in continuous casting processes.

BACKGROUND OF THE INVENTION

There are two primary categories of continuous steel casting processes, i.e. "close casting" and "open casting". In close casting processes, the use of a particular tube made from ceramic material, known as "submerged entry nozzle" (SEN), for conveying the liquid steel from the tundish to the mould allows most modern lubrication systems to be used, consisting of continuous casting powders. In open casting, where the cost due to the provision of the submerged entry nozzle is less, lubricating oils of mineral, vegetable or synthetic origin are typically used. This type of lubricant, however, does not always ensure effective lubrication. Consequently, there is excessive formation of scaling, cracks, lozenging and difficulty of lamination.

Casting powders used in close casting, normally consist of a mixture of various minerals. Such powders are available in various forms, for example, atomized granular powders, extruded powders and powders obtained by fitting. In terms of chemical composition, casting powders typically include a complex mixture of carbon, various oxides of mineral or synthetic origin (including $SiO_2$, $Al_2O_3$, $Na_2O$, CaO) and other materials.

There are four main functions carried out by lubricating powders, once added to the surface of the molten steel in the ingot mould, summarised as follows: i) heat insulation of the liquid steel in the CC mould, to prevent it from solidifying; ii) protection of the surface of the steel from oxidation; iii) lubrication and control of the heat exchange between the wall of the ingot mould and the outer shell of solidified steel; and iv) absorption of possible non-metallic inclusions coming from the steel. The powders, once poured into the ingot mould, lose part of the carbon by oxidation and heat up in contact with the liquid steel, forming a sintered layer and a molten one. The latter is distributed over the entire free surface of the steel and, thanks to the oscillations of the mould, infiltrates in the gap between it and the outermost shell of solidified steel. In this way, the liquid layer acts as a lubricant. The liquid that has infiltrated in turn partially solidifies in contact with the ingot mould, the wall of which is generally water-cooled, forming a layer of solid slag. The role of this layer is to allow an adequate level of heat transfer between the solidified steel shell and the ingot mould.

The casting powders make it possible to obtain a better quality steel, but they have the drawback of poor manageability, which makes them difficult to apply to open casting. In particular, the use of a casting powder is difficult to carry out due to particular feeding systems to be implemented with regard to the electromechanical, electronic and automation details.

SUMMARY OF THE INVENTION

The purpose of the present invention is therefore to provide a lubricating composition for a mould, able to be used both in continuous close and open casting processes, characterised by substantial manageability in its application to the process and prolonged shelf-life, making it possible to ensure a high quality standard of steel.

Such a purpose is accomplished by a lubricating compositions for a mould as described herein.

DETAILED DESCRIPTION

The present invention provides lubricating compositions for continuous casting steel production processes. Such compositions include a dispersion of a lubricating powder in a liquid medium.

The lubricating powder may include any casting powder normally used in continuous casting processes. In particular, lubricating powders may be formulated to maximize the rate of phase transition, in order to form the first liquid phase at less than 600° C., and in some embodiments at about 580° C., to obtain molten slags with good lubricating action.

In one embodiment, such lubricating powders include carbon in the graphite, milled coke and/or lamp black forms, $SiO_2$, $Al_2O_3$, $Na_2O$, CaO, fluorides, transition metal oxides and other oxides having the following characteristics:

- Basicity Index calculated as $CaO/SiO_2$ wt/wt, in the range of about 0.25-1.8;
- Alkali content, in the range of about 0.1-15.0% wt.;
- Alkaline earth metal content, in the range of about 0.1-45.0% wt.;
- Alumina content, in the range of about 0.1-25.0% wt.;
- MnO, $MnO_2$ and $Fe_2O_3$ content in the range of about 0.1-15.0% wt.;
- Fluoride content, $F^-$, in the range of about 0.1-14.0% wt.;
- Content of other oxides such as $TiO_2$, $B_2O_3$, $La_2O_3$, in the range of about 0.1-15.0% wt;
- Average particle size of the components in the range of about 0.1-40 μm, measured according to ASTM D4464-10 standard method.

The size of the solid particles is an important characteristic, since it defines the maximum packing fraction ($\Phi_m$) and consequently the relative viscosity of the dispersion.

In certain embodiments the liquid medium is an oily medium. The lubricating oils normally used in these types of processes may be used in embodiments of the present invention. In one embodiment, the oily medium includes mainly glyceric esters of fatty acids, such as a glyceric ester of oleic acid, or poly-α-olefins.

The liquid medium functions as a carrier for the solid component. In this way the lubricating composition may be loaded by using conventional pump means.

In certain embodiments the liquid medium may have a kinematic viscosity, $\mu_o$ between about 25 and 100 $mm^2/s$ at 40° C. (ASTMD445, gravimetric method with capillary viscometer) and a pour point ≤ of about −20° C., measured according to the ASTM D-97 standard method. This latter feature avoids the formation of sludge at low temperatures.

Another important feature of lubricating compositions of the present invention is the fraction in volume Φ of solid to liquid component, which is calculated according to the expression $\Phi=C_M/\rho_P$, wherein $C_M$ is the weight concentration of the solid component in the liquid component and $\rho_P$ is the bulk density of the solid component. In the case of mixtures of solid components, as in the present case, the $\rho_P$ is a weighted means of the $\rho_P$ of the single components, which are reported in literature.

In embodiments of the present invention, the lubricating compositions of the present invention may have a fraction in volume $\Phi$ of solid dispersed in the liquid medium between about 0.10 and 0.65, a density $\rho_d$ between about 1.0 and 1.8 kg/l (measured according to ASTM D1298 standard method) and a relative viscosity $\eta_r=\eta/\mu_0$ between about 1.25 and 2.50, where $\eta$ is the kinematic viscosity of the dispersion at 40° C. (measured according to ASTMD445 standard method) and $\mu_0$ is the kinematic viscosity of the liquid medium at 40° C. (measured according to ASTMD445 standard method).

Lubricating compositions of the present invention may be produced with a process that includes the following operative steps:

a) Providing a lubricating powder having an average particle size between about 20 and 40 micron and having a melting onset point in certain embodiments below about 600° C., and in other embodiments of about 580° C.;

b) Providing a liquid medium having a kinematic viscosity, $\mu_0$ between about 25 and 100 $mm^2/s$ at 40° C. (measured according to ASTMD445 standard method);

c) Dispersing said lubricating powder in said liquid medium.

The term "melting onset point" as used in the present description means the lowest temperature at which the solid starts to melt, that is the temperature at which the first drop of liquid is formed. This definition is applicable to mixture of substances that typically melt in a wide range of temperatures.

In certain embodiments, step a) of providing the lubricating powder with the desired grain size may be carried out by grinding the granulate with hammer mills, ball mills or jet mills and/or by sieving the granulate with sieves of suitable fineness of the mesh.

In certain embodiments, step c) of dispersing the solid in the liquid may be carried out by adding the solid into the liquid and using a disperser having an impeller with Reynolds number ≤10. For example, it is possible to use a six-bladed disc like that used in a Rushton turbine, a sawblade impeller like that used in a Cowles impeller, anchor impellers, helical ribbon impellers or of the Ekato PARAVISC type (Ekato, Handbook).

In certain embodiments, during the addition of lubricating powder to the liquid medium according to step c), the speed of the impeller may be brought from about 80-120 rpm to about 250-450 rpm in a gradual manner or in discreet increments, and then may be increased to about 650-950 rpm for a time between about 45 minutes and 80 minutes.

More specifically, the liquid medium may be loaded into the disperser and then may be kept under stirring at low revs, for example, about 100 rpm, and then the lubricating powder may be added in portions. Each time solid is added the viscosity increases, for which reason the speed of the impeller also increases, typically up to about 300-400 rpm. After the last addition the speed of the impeller may be brought to about 700-900 rpm for about 50 minutes. After having checked that the density and the viscosity are within the ranges indicated above, it may be stirred at about 700-900 rpm for another 10 minutes and the values of such properties, which should be within the desired limits, are rechecked.

Step c) may include a premixing stage of the solid in the liquid in suitable ratios as outlined above. Such premixing, for example, may be carried out in a ploughshare mixer.

Processes according to the present invention provide fluid that has non-newtonian characteristics, obtained by adjusting its stress yield by means of the tixotropic degree that is induced by the dispersion of the solid component into the liquid medium. The sedimentation rate is thus advantageously decreased.

In another embodiment, processes of the invention may be carried out in a single stage, introducing a mixture of the lubricating powder into the liquid medium in a ball mill or in a colloid mill and at the same time obtaining both the grinding of the solid and its dispersion in the liquid medium. In this embodiment, however, the control of the grain size of the solid is not as optimal.

It should be understood that lubricating compositions according to the invention may be adapted to different process requirements and to the different types of steel to be produced, while still remaining within the limits of the parameters defined above. For example, it is possible to adapt the kinematic viscosity of the lubricant to the particular transportation requirements thereof to the continuous casting machine, taking into account the load losses of the feeding line. It is also possible to adapt the fraction of dispersed solid so that for the same volume pumped it is possible to feed the continuous casting machine with a suitable amount of dispersed powder. Moreover, the composition of the latter in turn may be adapted to the requirements of the process as generally known for continuous casting powders. It is further possible to adapt the basicity index according to whether sticking or cracking sensitive steels are being produced. When casting construction steel in square billets with section about 145-160 mm at the speed of about 2.5-3.5 m/min the lubricant can have the following characteristics:

Solid fraction about 55-60% wt.;

Liquid base made up of a glyceric ester of oleic acid of kinematic viscosity between about 60 and 75 $mm^2/s$ at 40° C.;

Relative viscosity of the lubricant between about 3.7 and 4.2;

Basicity Index calculated as $CaO/SiO_2$ wt/wt, in the range of about 0.81±0.05;

Alkali content, in the range of about 5.0-8.0% wt.;

Lime content, in the range of about 35.0-39.0% wt.;

Silica content, in the range of about 44.0-48.0% wt.;

Alumina content, less than about 2.0% wt.;

Fluoride content, $F^-$, in the range of about 5.0-7.0% wt.;

Average particle size of the components of about 0.1-40 μm.

Lubricating composition of the invention may be used in quantities between about 100 and 500 g/ton of steel cast.

The use of lubricating composition of the invention has made it possible to obtain substantial advantages in continuous casting processes, both in open and closed casting, such as the disappearance of lozenging and the consequent disappearance of cracks at the edges, an increase in yield thanks to a substantial decrease in the formation of scaling (reduction of about 30-70% in scale weight) and a decrease in the formation of cracks in general.

Another important advantage is the ability to casting speed after suitable adjustments, the flows of primary and secondary cooling water.

The use of lubricating compositions of the invention also allow the use of, as a source of steel, poor quality scrap, making it possible to cast steel that contains up to about 30 ppm of sulphur.

In conclusion, lubricating compositions of the invention have advantages typical of oils, i.e. easy storage, easy manageability, lack of airborne dust formation during use, lower susceptibility to humidity, prolonged shelf-life, without however losing the quality standards that are typically obtained with casting powders. Another advantage is improved environmental compatibility with respect to the known lubricating compositions.

It should be noted that a person of skill in the art based on the present disclosure may bring further modifications and variants to lubricating composition according to the invention, in order to satisfy contingent and specific requirements, all of which are intended to be covered by the scope of protection of the invention.

The invention claimed is:

1. A lubricating composition for continuous casting steel production processes, said lubricating composition comprising a dispersion of a lubricating powder in a liquid medium, wherein the lubricating powder has a melting onset point below 600° C., measured at 1 atm of pressure, wherein said lubricating powder comprises carbon in graphite, milled coke or lamp black form, $SiO_2$, $Al_2O_3$, $Na_2O$, CaO, fluorides, transition metal oxides and other oxides and wherein it includes the following characteristics:

Basicity Index calculated as $CaO/SiO_2$ wt/wt, in the range 0.25-1.8;

Alkali content in the range 0.1-15.0% wt.;

Alkaline earth metal content in the range 0.1-45.0% wt.;

Alumina content in the range 0.1-25.0% wt.;

MnO, $MnO_2$ and $Fe_2O_3$ content in the range 0.1-15.0% wt.;

Fluoride content, $F^-$ in the range 0.1-14.0% wt.;

Content of other oxides in the range 0.1-15.0% wt.; and

Average particle size of the components 0.1-40 μm, measured according to an ASTM D4464-10 standard method.

2. The lubricating composition of claim 1, wherein the lubricating powder has a melting onset point of about 580° C.

3. The lubricating composition of claim 1, wherein said lubricating powder comprises powder of the type used in casting processes.

4. The lubricating composition of claim 1, wherein said liquid medium comprises an oily medium.

5. The lubricating composition of claim 4, wherein said oily medium comprises glyceric esters of fatty acids and/or poly-α-olefins.

6. The lubricating composition of claim 1, wherein said liquid medium comprises a lubricant oil of the type used for casting processes.

7. The lubricating composition of claim 1, wherein said liquid medium has a kinematic viscosity $\mu_0$ between about 25 and 100 $mm^2/s$ at 40° C. measured according to ASTMD445 standard method, and a pour point ≤ about −20° C., measured according to ASTM D-97 standard method.

8. The lubricating composition of claim 1, wherein said lubricating composition has a fraction in volume Φ of solid dispersed in the liquid medium between about 0.10 and 0.65, a density $\rho_d$ between about 1.0 and 1.8 kg/1, measured according to ASTM D1298 standard method, and a relative viscosity $\eta_r=\eta/\mu_0$ comprised between about 1.25 and 2.50, where η is the kinematic viscosity of the dispersion at 40° C. measured according to ASTMD445 standard method and $\mu_0$ is the kinematic viscosity of the liquid medium at 40° C. measured according to ASTMD445 standard method.

9. A method for preparing the lubricating composition of claim 1, said process comprising the steps of:

a) providing a lubricating powder having an average particle size between about 20 and 40 micron and a melting onset point below about 600° C.;

b) providing a liquid medium having a kinematic viscosity, between about 25 and 100 $mm^2/s$ at 40° C. measured according to ASTMD445 standard method; and c) dispersing said lubricating powder in said liquid medium.

10. The method of claim 9, wherein step a) is carried out by grinding the granulate with hammer mills, ball mills or jet mills and/or by sieving the granulate with sieves having suitable mesh fineness.

11. The method of claim 9, wherein step c) is carried out by adding the solid into the liquid medium and using a disperser having an impeller with Reynolds number ≤10.

12. The method of claim 11, wherein said c) is carried out using an impeller selected from the group consisting of a six-bladed disc of the type used in a Rushton turbine, a saw-blade impeller of the type used in the Cowles impeller, anchor impellers, an impeller with a helical ribbon and the Ekato PARAVISC type.

13. The method of claim 9, wherein, during step c), the speed of the impeller is brought from about 80-120 rpm to about 250-450 rpm in a gradual manner or in discrete increments, and then is further increased to about 650-950 rpm for a time between about 45 minutes and 80 minutes.

14. The method of claim 9, wherein said step c) further comprises premixing the solid in the liquid.

15. The method of claim 9, wherein said process is carried out in a single step, by introducing a mixture of the lubricating powder into the liquid medium in a ball mill or into a colloid mill and concurrently obtaining both the grinding of the solid and its dispersion in the liquid medium.

16. A method for continuous steel casting comprising adding the lubricating composition of claim 1, wherein said lubricating composition is used in an amount between about 100 and 500 g/ton of steel cast.

* * * * *